US011591191B2

(12) United States Patent
Chalavon et al.

(10) Patent No.: US 11,591,191 B2
(45) Date of Patent: Feb. 28, 2023

(54) DOUBLE-REEVED LIFTING DEVICE WITH A LATCH-LOCKING MECHANISM

(71) Applicant: MANITOWOC CRANE GROUP FRANCE, Dardilly (FR)

(72) Inventors: Jonathan Chalavon, Mions (FR); Adrien Gourru, Lyons (FR)

(73) Assignee: Manitowoc Crane Group France, Dardilly (FR)

( * ) Notice: Subject to any disclaimer, the term of this patent is extended or adjusted under 35 U.S.C. 154(b) by 0 days.

(21) Appl. No.: 17/477,468

(22) Filed: Sep. 16, 2021

(65) Prior Publication Data

US 2022/0081267 A1 Mar. 17, 2022

(30) Foreign Application Priority Data

Sep. 16, 2020 (FR) ..... 2009385

(51) Int. Cl.

| | |
|---|---|
| ***B66D 3/10*** | (2006.01) |
| ***B66C 13/00*** | (2006.01) |
| ***B66D 3/04*** | (2006.01) |

(52) U.S. Cl.

CPC ..... *B66D 3/10* (2013.01); *B66C 13/00* (2013.01); *B66D 3/043* (2013.01); *B66C 2700/017* (2013.01); *B66D 2700/03* (2013.01)

(58) Field of Classification Search

CPC .. B66D 3/10; B66D 3/043; B66D 1/00; B66C 13/00; B66C 2700/017

See application file for complete search history.

(56) References Cited

U.S. PATENT DOCUMENTS 3,306,469 A 2/1967 Durand

FOREIGN PATENT DOCUMENTS

| | | | | |
|---|---|---|---|---|
| CN | 208761990 U | * | 4/2019 | ..... B66C 1/36 |
| DE | 2845874 A1 | | 4/1980 | |
| DE | 3149690 A1 | | 6/1983 | |
| DE | 3543214 A1 | | 12/1986 | |
| FR | 1520612 A | | 4/1968 | |
| FR | 2131924 A1 | | 11/1972 | |
| FR | 2137333 A1 | | 12/1972 | |

(Continued)

OTHER PUBLICATIONS

FR search report and written opinion issued by French Patent Office (INPI) dated May 27, 2021, in connection with corresponding FR Appl. 20/09385.

*Primary Examiner* — Emmanuel M Marcelo

(74) *Attorney, Agent, or Firm* — Cook Alex Ltd.

(57) ABSTRACT

A double-reeved lifting device includes a lower reeve block secured to a lifting hook and an upper reeve block, wherein the two reeve blocks include reversible connection means adapted to be reversibly configured between a connected configuration and a disconnected configuration. The reversible connection means include a locking mechanism and a complementary locking structure having a frame securely supporting a bolt. The locking mechanism includes a chassis having a locking channel provided with a mouthpiece through which the bolt is configured to enter and exit and slide in the locking channel respectively upon a relative approach or distancing between the two reeve blocks, and at least one latch pivotally mounted on the chassis so as to pivot inside the locking channel, the latch provided with a free end adapted to engage with the bolt.

18 Claims, 8 Drawing Sheets

(56) References Cited

FOREIGN PATENT DOCUMENTS

| | | | | | |
|---|---|---|---|---|---|
| FR | 2228024 | A1 | | 11/1974 | |
| FR | 2333743 | A1 | | 7/1977 | |
| FR | 2368431 | A1 | | 5/1978 | |
| FR | 2646660 | A1 | * | 11/1990 | |
| GB | 2176456 | A | | 12/1986 | |
| IT | MI20101302 | A1 | | 1/2012 | |
| KR | 100930278 | B1 | * | 12/2009 | |
| RU | 2521088 | C2 | * | 6/2014 | ..... B66C 1/34 |
| WO | WO-2010090722 | A2 | * | 8/2010 | ..... B63H 9/08 |

* cited by examiner

DOUBLE-REEVED LIFTING DEVICE WITH A LATCH-LOCKING MECHANISM

FIELD

The present disclosure relates to a double-reeved lifting device for a lifting machinery, as well as a lifting machinery and a lifting method associated thereto.

The present disclosure finds an application, yet without limitation, for a lifting machinery such as a crane, and in particular a tower crane.

BACKGROUND

In a known manner, a double-reeved lifting device is adapted to be reversibly configured between two reeving configurations including a simple-reeved configuration with two lifting strands and a double-reeved configuration with four lifting strands, wherein the double-reeved lifting device comprises a reeving change system to perform a change of reeving between the simple-reeved configuration and the double-reeved configuration.

Conventionally, such a double-reeved lifting device comprises two reeve blocks, namely a lower reeve block secured to a lifting hook and an upper reeve block, and these two reeve blocks comprise reversible connection means adapted to be reversibly configured between:

- a connected configuration in which the upper reeve block is connected to the lower reeve block so as to be able to accompany it in ascending/descending movements, and
- a disconnected configuration in which the upper reeve block is disconnected from the lower reeve block so as to be able to remain hanging above the lower reeve block which could perform descending/ascending movements without the upper reeve block.

The lower reeve block is hanging from the lifting machinery by a lifting rope connected to a lifting winch to make the lower reeve block ascend/descend, and this lifting rope passes through the upper reeve block, so that the connected configuration and the disconnected configuration respectively correspond to a double-reeved configuration and to a simple-reeved configuration, or vice versa, of the double-reeved lifting device, depending on the passage of the lifting rope at the level of the upper reeve block.

For example, the documents FR 1 520 612, FR 2 137 333, FR 2 368 431, FR 2 131 924, FR 2 228 024 describe double-reeved lifting devices in which the connected configuration corresponds to the double-reeved configuration, and the disconnected configuration corresponds to the simple-reeved configuration; the lifting rope passing under a pulley carried by the upper reeve block.

And conversely, the documents GB 2 176 456, FR 2 333 743, DE 31 49 690, DE 35 43 214 describe double-reeved lifting devices in which the connected configuration corresponds to the simple-reeved configuration, and the disconnected configuration corresponds to the double-reeved configuration; the lifting rope passing above a pulley carried by the upper reeve block.

However, the reversible connection means known in this prior art to connect/disconnect the two reeve blocks, are barely satisfactory. Indeed, some of them involve numerous parts which become loose, reduce the reliability of the mechanism and require a lot of maintenance, not to mention the high manufacturing costs, others require accessories to activate actuators located in general at the root of the jib, which limits the possibilities of replacement of the reeving at the root of the jib, posing an accessibility problem if the latter is in an inaccessible area of the work site, other still require manual operations on the ground for connecting/disconnecting the reeve blocks which might turn out to be dangerous if they are badly performed, and which are time-consuming.

SUMMARY

The present disclosure aims at solving at least part of the aforementioned drawbacks, by providing a double-reeved lifting device equipped with robust reversible connection means as they are composed by few parts.

The present disclosure also aims at providing reversible connection means equipped with a locking mechanism with movable parts mounted only on one of the two reeve blocks, the other reeve block comprising no movable parts for the connection/disconnection of the two reeve blocks, which may be advantageous in terms of maintenance and reliability.

The present disclosure also aims at reducing the bulk of the lifting device, in particular in the double-reeved configuration in order to enhance the capability of displacement along the jib.

The present disclosure also aims at providing a double-reeved lifting device allowing switching automatically, without any manual intervention, from the double-reeved configuration into the simple-reeved configuration, and vice versa, in a reliable, rapid and reproducible way over time.

Thus, the present disclosure provides a double-reeved lifting device for a lifting machinery, such as for example a crane, comprising two reeve blocks, namely a lower reeve block secured to a lifting hook and an upper reeve block, wherein the two reeve blocks comprise reversible connection means adapted to be reversibly configured between:

- a connected configuration in which the upper reeve block is connected to the lower reeve block so as to be able to accompany it in ascending/descending movements along a main axis, and
- a disconnected configuration in which the upper reeve block is disconnected from the lower reeve block so as to be able to remain hanging above the lower reeve block which could perform descending/ascending movements without the upper reeve block, wherein the connected configuration and the disconnected configuration respectively correspond to a double-reeved configuration and to a simple-reeved configuration, or vice versa, of the double-reeved lifting device, said double-reeved lifting device being characterized in that the reversible connection means comprise a locking mechanism mounted on one of the two reeve blocks, and a complementary locking structure mounted on the other one of the two reeve blocks and adapted to cooperate with the locking mechanism;

wherein the complementary locking structure comprises a frame securely supporting a bolt formed at least partially by a shaft extending transversely to the main axis, and wherein the locking mechanism comprises:

- a chassis comprising a locking channel having an elongated shape along the main axis and provided with a mouthpiece through which the bolt could come in and come out of the locking channel and could slide in the locking channel in an entry direction and in an exit direction, opposite to the entry direction, respectively upon a relative approach or distancing between the two reeve blocks, and at least one latch pivotally mounted on the chassis about a pivot axis so as to pivot inside the locking channel, said latch being provided with a concave-shaped free end adapted to engage with the bolt, and being coupled to an elastic biasing element urging said latch towards a neutral position.

Thus, the present disclosure provides reversible connection means which are shaped so as to convert ascending/descending movements of the lower reeve block (vertical translational movements) into sliding movements of the bolt in the locking channel so that it engages with the free end of the or of each latch or so that it is released from this free end or from each of these free ends, which will allow connecting/disconnecting the two reeve blocks easily, and that being so in a safe and reliable manner since few movable parts are necessary, only the latch(s) being movable. Moreover, the connection/disconnection phases can be easily automated, since all it needs is to control the ascending/descending movements of the lower reeve block (by simply controlling the motor-driven system of the lifting winch) to switch from a disconnected configuration into a connected configuration, and vice versa.

In one example, the latch is pivotally movable between: the neutral position;

a distal position, in which the latch clears the passage for the bolt by the effect of a push exerted by said bolt sliding in the entry direction, said distal position being associated to a pivoting of the latch in a distal rotational direction from the neutral position;

a proximal position, in which the latch clears the passage for the bolt by the effect of a push exerted by said bolt sliding in the exit direction, said proximal position being associated to a pivoting of the latch in a proximal rotational direction, opposite to the distal rotational direction, from the neutral position; and a locking position, intermediate between the neutral position and the distal position, in which the free end of the latch blocks sliding of the bolt in the locking channel in the exit direction, with the bolt stuck inside said free end.

In an embodiment, the free end of the latch has an indentation with a shape complementary to the bolt.

According to one feature, the bolt has a cylindrical section at a determined diameter, and the indentation of the free end of the latch has a circle-arc shaped load-bearing area.

According to one possibility, the circle-arc shaped load-bearing area of the indentation of the latch has a diameter equivalent to the diameter of the bolt.

According to another possibility, the locking channel has a width substantially equivalent to the diameter of the bolt.

In an embodiment, the indentation of the free end of the latch is delimited by two opposite sears on which the bolt could exert a push, namely a proximal sear, facing the mouthpiece of the locking channel in the neutral position, and a distal sear, wherein the proximal sear and the distal sear respectively have a proximal length and a distal length measured radially from the pivot axis, and the proximal length is smaller than the distal length.

According to one feature, the locking channel has a bottom, adapted to stop a sliding of the bolt in the entry direction, wherein the latch is disposed between the mouthpiece and the bottom of the locking channel.

According to another feature, the pivot axis of the latch is orthogonal to the main axis.

According to one variant, the locking mechanism comprises two latches facing each other, pivotally mounted on the chassis on either side of the locking channel, said two latches being pivotable symmetrically with respect to a main plane including the main axis and parallel to the pivot axis of each of the two latches.

Of course, it could be considered to provide for more than two latches, for example with latches arranged side-by-side.

According to one possibility, the two latches are identical and symmetrical with respect to the main plane.

According to another possibility, the frame of the complementary locking structure comprises two flanges facing each other, between which the bolt is fastened.

In an embodiment, the chassis of the locking mechanism comprises two plates between which the latch is pivotally mounted.

According to another possibility, the at least one striker orifice comprises a second oblong section along a direction parallel to the main axis, disposed at the middle of the first oblong section.

The present disclosure also relates to a lifting machinery, such as for example a crane, comprising a jib and a double-reeved lifting device formed so as to lift/lower a load along the jib, said double-reeved lifting device being in accordance with the present disclosure, wherein the lower reeve block hangs from the jib by a lifting rope connected to a lifting winch to make the lower reeve block ascend/descend, said lifting rope passing through the upper reeve block, and wherein:

starting from the disconnected configuration with the upper reeve block hanging above the lower reeve block and with the latch in the neutral position, said lower reeve block could be raised for a relative approach between the two reeve blocks until the upper reeve block reaches the high stop on the jib and the bolt comes into the locking channel through the mouthpiece, slides inside the locking channel in the entry direction and exerts a push on the latch to bring it in a distal position until fitting inside the free end of the latch, and then the lower reeve block could be displaced in descent so that the bolt slides inside the locking channel in the exit direction and brings the latch in a locking position, so that the bolt is stuck inside said free end and its sliding in the locking channel in the exit direction is blocked, so that the lower reeve block could descend with the upper reeve block in the connected configuration; and starting from the connected configuration with the latch in the locking position and the bolt stuck inside the free end of the latch, said lower reeve block could be raised until the upper reeve block reaches the high stop on the jib, and then the bolt slides inside the locking channel in the entry direction and brings the latch in an intermediate distal position, so that the bolt leaves the inside of the free end of the latch and afterwards the latch returns back into the neutral position by the effect of the elastic biasing element, and then the lower reeve block could be displaced in descent so that the bolt slides inside the locking channel in the exit direction, pushes the latch towards a proximal position until coming out of the locking channel and being released from the latch, so that the lower reeve block could continue descending in the disconnected configuration.

To the extent that the lifting winch allows making the lower reeve block ascend/descend, then the change in the configuration between the connected configuration and the disconnected configuration (and therefore between the double-reeved configuration and the simple-reeved configuration) take place only when controlling the lifting winch, thereby allowing for simple operation.

In an embodiment, the lifting machinery comprises a distribution trolley movably mounted on the jib and linked to a distribution system adapted to displace the distribution trolley along the jib in opposite forward direction and backward direction, and wherein the lower reeve block hangs from said distribution trolley by the lifting rope.

The present disclosure also concerns a method for lifting a load in a lifting machinery in accordance with embodiments herein, comprising:

- a connection phase for a switch from the disconnected configuration into the connected configuration, during which the lower reeve block is mounted for a relative approach between the two reeve blocks until the upper reeve block reaches the high stop on the jib and the bolt comes into the locking channel through the mouthpiece, slides inside the locking channel in the entry direction and exerts a push on the latch to bring it into the distal position until fitting inside the free end of the latch, and then the lower reeve block is displaced in descent so that the bolt slides inside the locking channel in the exit direction and brings the latch into the locking position, and thus the bolt is stuck inside said free end and its sliding in the locking channel in the exit direction is blocked, so that the lower reeve block could descend with the upper reeve block in the connected configuration; and
- a disconnection phase for a switch from the connected configuration into the disconnected configuration, during which the lower reeve block is raised until the upper reeve block reaches the high stop on the jib, and then the bolt slides inside the locking channel in the entry direction and brings the latch into a distal position, so that the bolt leaves the inside of the free end of the latch and the latch returns back into the neutral position by the effect of the elastic biasing element, and then the lower reeve block is displaced in descent so that the bolt slides inside the locking channel in the exit direction, pushes the latch towards the distal position until coming out of the locking channel, so that the lower reeve block could continue descending in the disconnected configuration.

The displacements of the lower reeve block, in the connection phase and in the disconnection phased, are automated.

According to one variant, in the connection phase and in the disconnection phase, the displacements of the lower reeve block are driven at a reduced speed, below a predefined speed threshold.

BRIEF DESCRIPTION OF THE DRAWINGS

Other features and advantages of the present disclosure will appear upon reading the detailed description hereinafter, of a non-limiting example of implementation, made with reference to the appended figures in which.

DESCRIPTION

Figure 1:
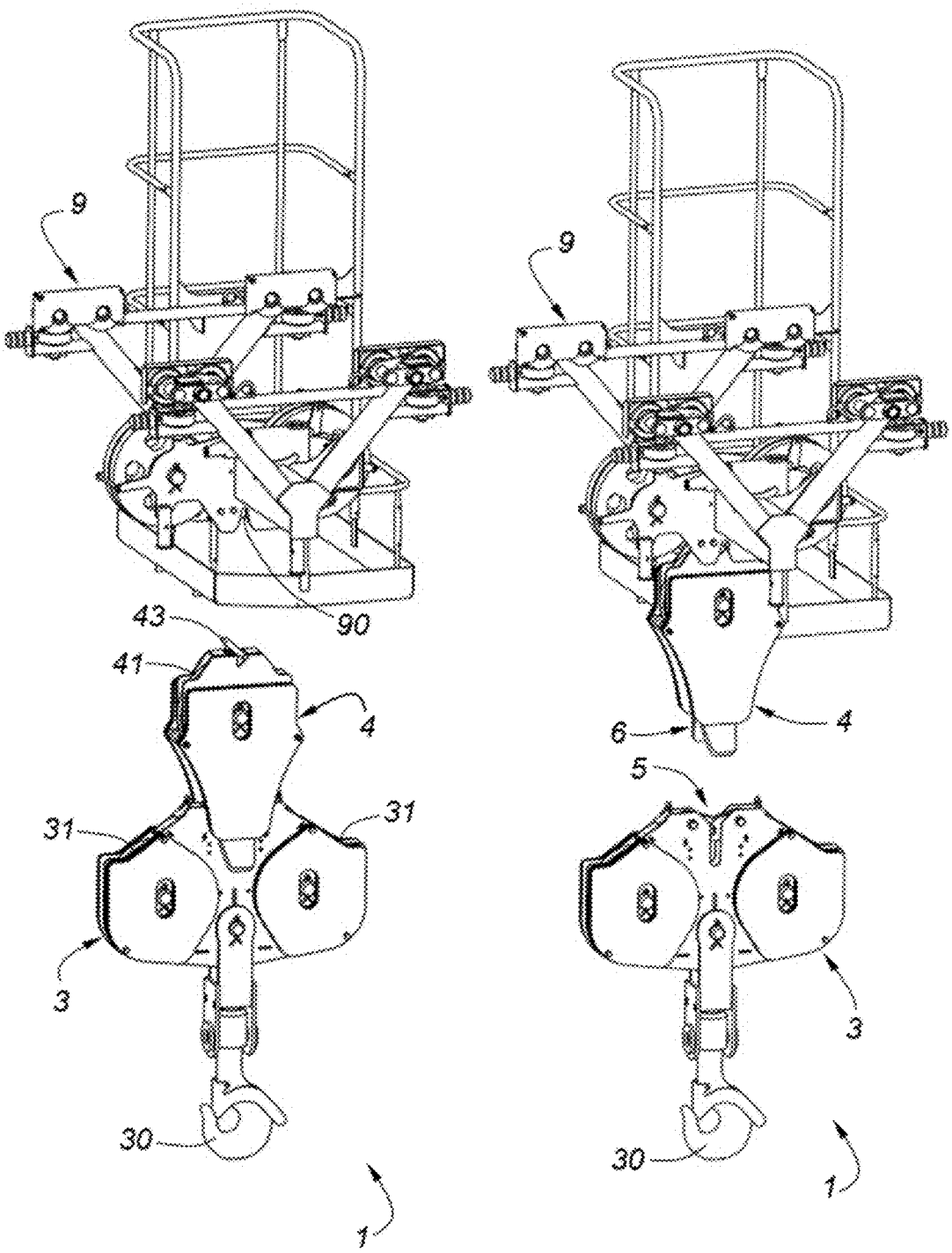
FIG. 1 is a schematic perspective view of a double-reeved lifting device according to an embodiment, when hanging from a distribution trolley, in a connected configuration (to the left) and in a disconnected configuration (to the right)

Referring to FIG. 1, a double-reeved lifting device 1 according to an embodiment is provided for a lifting machinery, such as for example a crane, which has a jib (not illustrated) and a distribution trolley 9 movably mounted on the jib and linked to a distribution system adapted to displace the distribution trolley 9 along the jib in opposite forward direction and backward direction; this distribution system consisting for example of a distribution winch which cooperates with a distribution rope for the displacement of the distribution trolley 9.

This double-reeved lifting device 1 comprises two reeve blocks 3, 4, namely:

- a lower reeve block 3 secured to a lifting hook 30 intended to hook a load, wherein the lower reeve block 3 hangs from the distribution trolley 9 (and therefore hangs from the jib) by a lifting rope (not illustrated) connected to a lifting winch so as to make the lower reeve block 3 rise/descend; and
- an upper reeve block 4 through which the lifting rope passes, the upper reeve block 4 also hanging from the distribution trolley 9.

Also, the lower reeve block 3 supports lower rope deflecting means, and the upper reeve block 4 supports upper rope deflecting means, such as for example a pulley 41, for the passage of the lifting rope. Thus, the double-reeved lifting device 1 is formed so as to lift/lower a load along the jib of the lifting machinery.

The two reeve blocks 3, 4 are equipped with reversible connection means adapted to be reversibly configured between:

- a connected configuration (illustrated in FIG. 1 to the left) in which the upper reeve block 4 is connected to the lower reeve block 3 so as to be able to accompany it in ascending/descending movements along a main axis of vertical extension, and
- a disconnected configuration (illustrated in FIG. 1 to the right) in which the upper reeve block 4 is disconnected from the lower reeve block 3 so as to be able to remain hanging above the lower reeve block 3 which could perform descending/ascending movements alone without the upper reeve block 4.

Depending on the passage of the lifting rope in the lower rope deflecting means provided on the lower reeve block 3 and in the upper rope deflecting means provided on the upper reeve block 4, the connected configuration and the disconnected configuration respectively correspond to a double-reeved configuration and to a simple-reeved configuration, or vice versa, of the double-reeved lifting device 1; the simple-reeved configuration being associated to holding of the hook 30 (and therefore of the load) by two lifting strands of the lifting rope, and the double-reeved configuration being associated to holding of the hook 30 (and therefore of the load) by four lifting strands of the lifting rope.

The reversible connection means comprise a locking mechanism 5 mounted on the lower reeve block 3, and a complementary locking structure 6 mounted on the upper reeve block 4 and adapted to cooperate with the locking mechanism 5.

Figure 3:
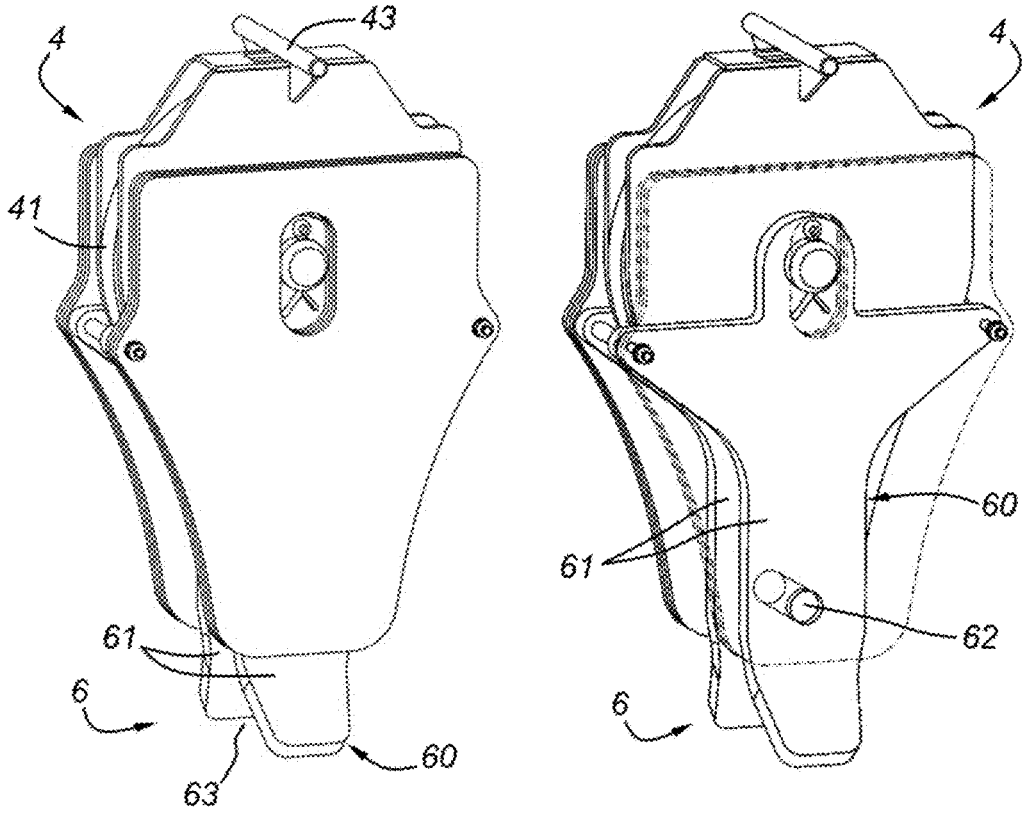
FIG. 3 is a schematic view of the upper reeve block, in a solid version (to the left) and in a partially transparent version (to the right)

Referring to FIG. 3, the complementary locking structure 6 is part of the upper reeve block 4 and it is provided below the upper rope deflection means, and therefore below the pulley 41 in the illustrated example. This complementary locking structure 6 comprises:

- a frame 60 comprising two flanges 61 facing each other and which delimit therebetween an open groove on the underside of the upper reeve block 4 so as to define an inlet 63; and
- a bolt 62 securely supported by the frame, wherein this bolt 62 forms a shaft extending along a longitudinal axis orthogonal to the main axis, and wherein this bolt 62 extends between the two flanges 61 at a determined distance from the inlet 63 of the groove.

The upper reeve block 4 supports an upper stop 43 at the upper portion thereof, opposite to the mouthpiece 63 of the complementary locking structure 6. Moreover, the flanges 61 are brought away from each other at the level of the inlet 63, so that this inlet 63 is flared.

Figure 2:
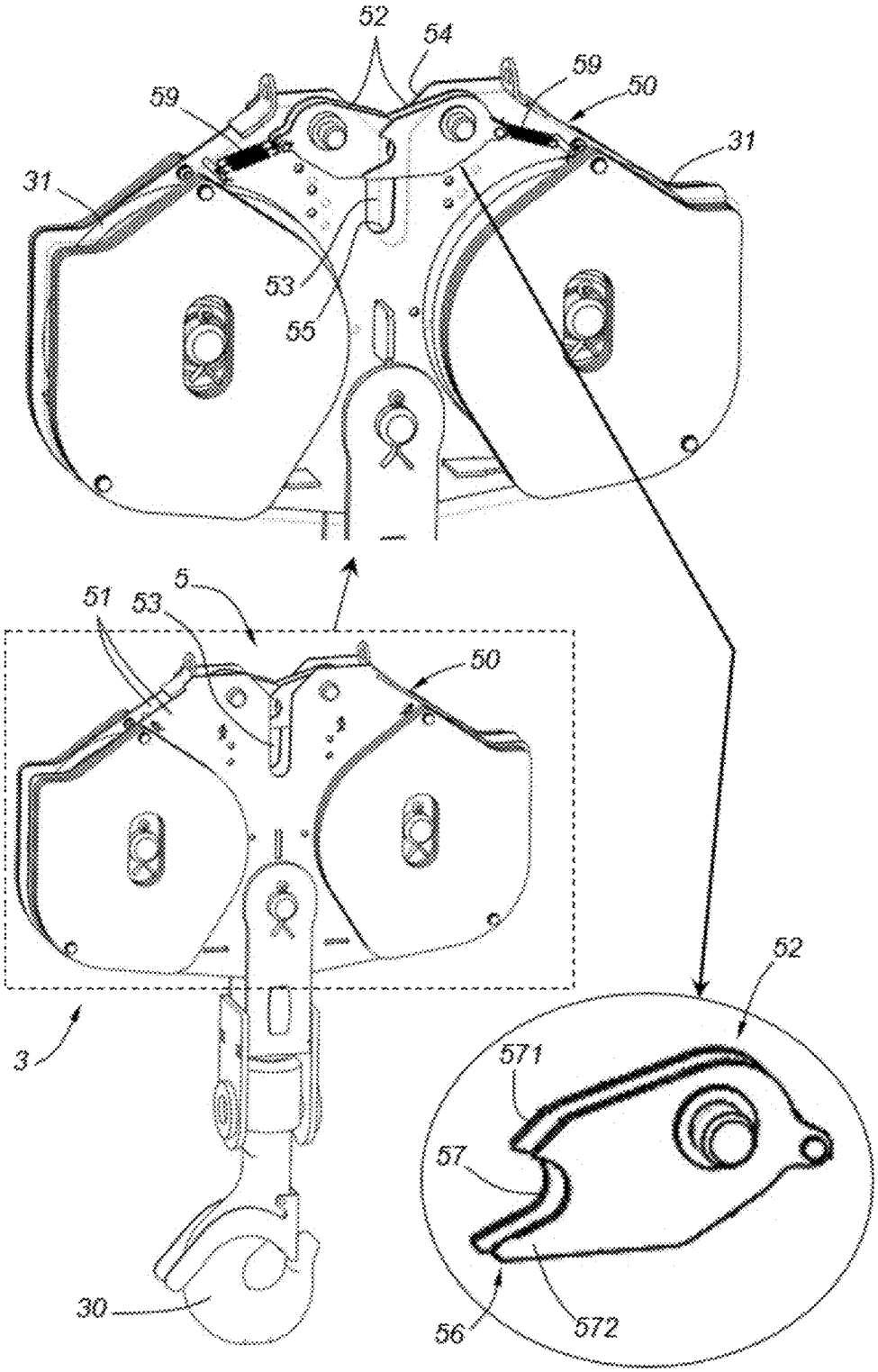
FIG. 2 is a schematic perspective view of a lower reeve block of the double-reeved lifting device of FIG. 1, in an overview version (to the bottom) and in an enlarged and partially transparent version (to the top), and with zooming on one latch alone.

Referring to FIG. 2, the locking mechanism 5 is integrated to the lower reeve block 3 and it is provided above the lower rope deflection means, and therefore above the two pulleys 31 in the illustrated example. This locking mechanism 5 comprises:

- a chassis 50 comprising two plates 51 facing each other and which delimit an interspace therebetween; and
- two latches 52 pivotally mounted on the chassis 50, between the two plates 51, wherein each latch 52 is coupled to an elastic biasing element 59, such as for example a spring.

The chassis 50 has a locking channel 53 having an elongated shape along the main axis (and therefore along a vertical direction), wherein this locking channel 53 is formed by two notches facing each other, formed in the two plates 51 and opening onto upper sears 510 of the plates 51, so that this locking channel 53 is provided with a mouthpiece 54 through which the bolt 62 of the complementary locking structure 9 could come in and come out of the locking channel 53. The mouthpiece 54 is flared so as to facilitate and center the insertion of the bolt 62 inside the locking channel 53.

The bolt 62 has a cross-section dimensioned so as to be able to slide in the locking channel 53. The inner distance between the two flanges 61 of the frame 60 is larger than the thickness of the chassis 50, so that the chassis 50 could come into the groove of the frame 60 (and therefore between the two flanges 61) via the inlet 63, which is flared to facilitate this passage.

Thus, the bolt 62 can slide in the locking channel 53 in an entry direction (downwards) and in an exit direction (upwards), opposite to the entry direction, respectively during a relative approach and distancing between the two reeve blocks 3, 4. It may be advantageous that the bolt 62 tightly slides (with a reduced clearance) inside the locking channel 53. This bolt 62 has a cylindrical section at a determined diameter. Thus, the locking channel 53 has a width substantially equivalent to the diameter of the bolt 62.

The locking channel 53 has a bottom 55, which is located between the two pulleys 31, wherein this bottom 55 is adapted to stop sliding of the bolt in the entry direction. It should be noted that the two pulleys 31 are also rotatably mounted between the two plates 51.

The two latches 52 are disposed facing each other on either side of the locking channel 53, and are pivotally mounted on the chassis 50, between the two plates 51, around parallel pivot axes; these pivot axes being also orthogonal to the main axis and also parallel to the longitudinal axis of the bolt 62. The two latches 52 are pivotable symmetrically with respect to a main plane including the main axis and parallel to the pivot axis of each of the two latches 52. The two latches 52 are identical and symmetrical with respect to the main plane.

Each latch 52 is provided with a concave-shaped free end 56 adapted to be engaged with the bolt 62, wherein the free end 56 has an indentation 57 with a shape complementary to the bolt 62. Thus, the indentation 57 of the free end 56 of the latch 52 has a circle-arc shaped load-bearing area at a diameter equivalent to the diameter of the bolt 62. Each latch 52 is disposed between the mouthpiece 54 and the bottom 55 of the locking channel 53.

For each latch 52, the indentation 57 of the free end 56 is delimited by two opposite sears 571, 572 on which the bolt 62 could exert a push, namely a proximal sear 571, facing the mouthpiece 54 of the locking channel 53, and a distal sear 572 facing the bottom 55 of the locking channel 53. Moreover, the proximal sear 571 and the distal sear 72 respectively have a proximal length and a distal length measured radially from the pivot axis, and the proximal length is smaller than the distal length.

For each latch 52, the corresponding elastic biasing element 59 extends between the two plates 51 and has an end fastened to the latch 52, and another end fastened on the chassis 50. It should be noted that, in FIGS. 4-13, all of the springs forming the elastic biasing elements 59 are illustrated at rest, with their ends not fastened to the latches 52 and to the chassis 50, for simplicity.

Each latch 52 is pivotally movable between:

- a neutral position (shown in FIGS. 6, 9 and 10), in which its free end 56 is located in the locking channel 53, wherein the corresponding elastic biasing element 59 urges the latch 52 towards this neutral position;
- a distal position (shown in FIG. 11), in which the latch 52 clears the passage for the bolt 62 by the effect of a push exerted by the bolt 62 sliding from the mouthpiece 54 in the entry direction (downwards) in the direction of the bottom 55, this distal position being associated to a pressure of the bolt 62 on the proximal sear 571 which causes a pivoting of the latch 52 in a distal rotational direction from the neutral position (downward pivoting of the latch 52);
- a proximal position (shown in FIG. 8), in which the latch 52 clears the passage for the bolt 62 by the effect of a push exerted by the bolt 62 sliding in the exit direction (upwards), this proximal position being associated to a pivoting of the latch 52 in a proximal rotational direction, opposite to the distal rotational direction, from the neutral position (upward pivoting of the latch 52);
- a locking position (shown in FIGS. 4 and 13), intermediate between the neutral position and the distal position, in which the free end 56 of the latch 52 blocks sliding of the bolt 62 in the locking channel 53 in the exit direction, with the bolt 62 stuck inside this free end 56;
- an intermediate distal position (shown in FIG. 5), which lies after the locking position and in which the latch 52 clears the passage for the bolt 62 by the effect of a push exerted by the bolt 62 sliding from the indentation 57 in the entry direction (downwards) in the direction of the bottom 55, this intermediate distal position being associated to a pressure of the bolt 62 on the distal sear 572 which causes a pivoting of the latch 52 in the distal rotational direction from the locking position (downward pivoting of the latch 52).

Figure 6:
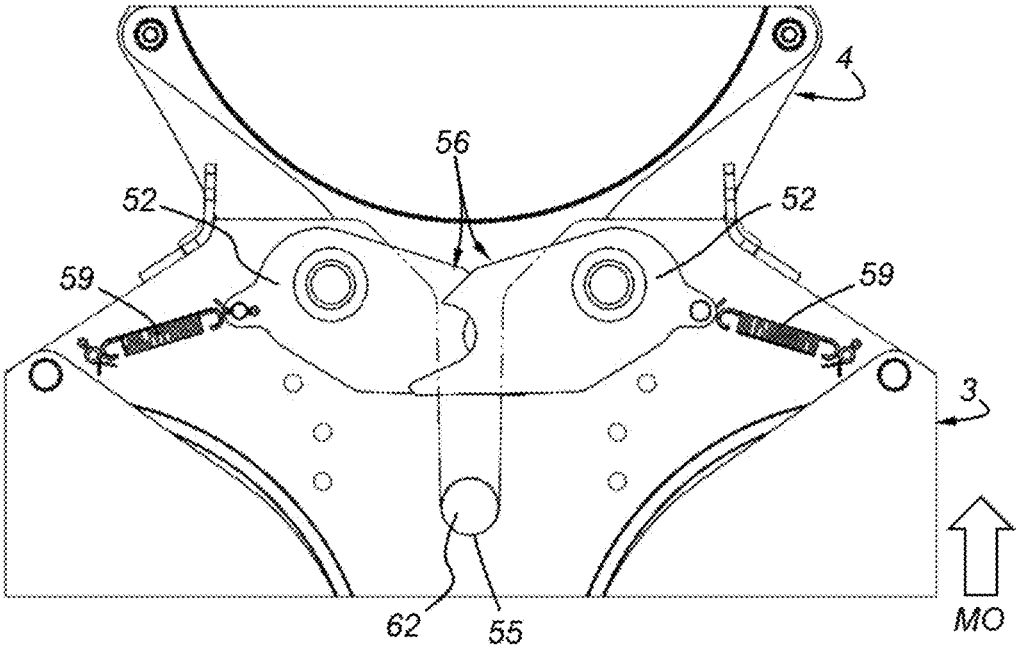
FIG. 6 is a schematic view equivalent to those of FIGS. 4 and 5, at the end of the first step of the disconnection phase, wherein the lower reeve block has finished rising until the bolt reaches the bottom of the locking channel and the latches return back into the neutral position.
Figure 9:
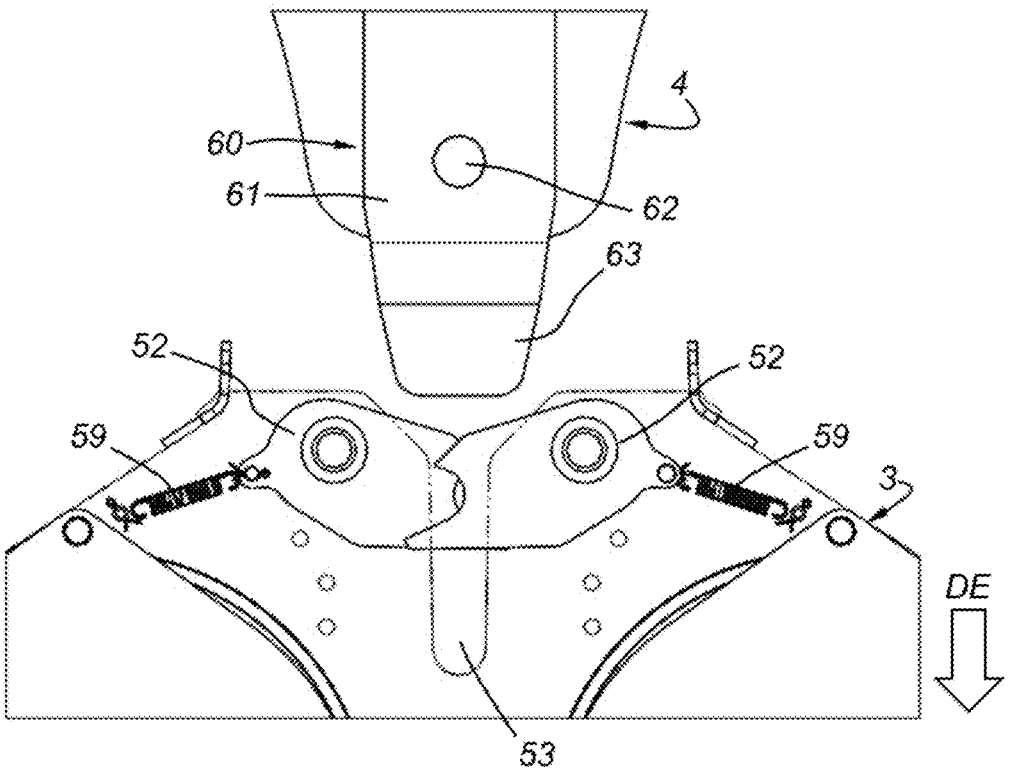
FIG. 9 is a schematic view equivalent to those of FIGS. 4-8, at the end of the second step of the disconnection phase, during which the lower reeve block continues descending so that the bolt is completely released from the lower reeve block and the latches have returned back into the neutral position, thereby completing the disconnection between the reeve blocks.
Figure 10:
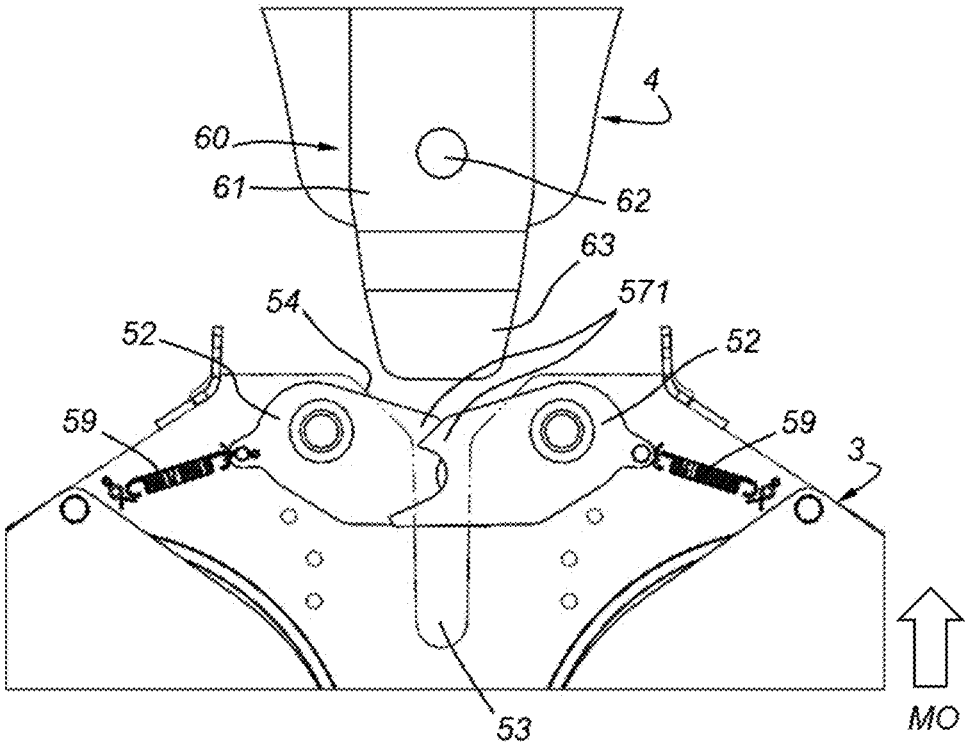
FIG. 10 is a schematic view equivalent to those of FIGS. 4-9, with the upper reeve block and the lower reeve block in the disconnected configuration, at the beginning of a first step of a connection phase during which the lower reeve block starts rising.

As shown in FIGS. 6, 9 and 10, in the neutral position, the free ends 56 of the latches overlap inside the locking channel 53.

The following description covers a disconnection phase for the switch from the connected configuration into the disconnected configuration, with reference to FIGS. 4-9.

Figure 4:
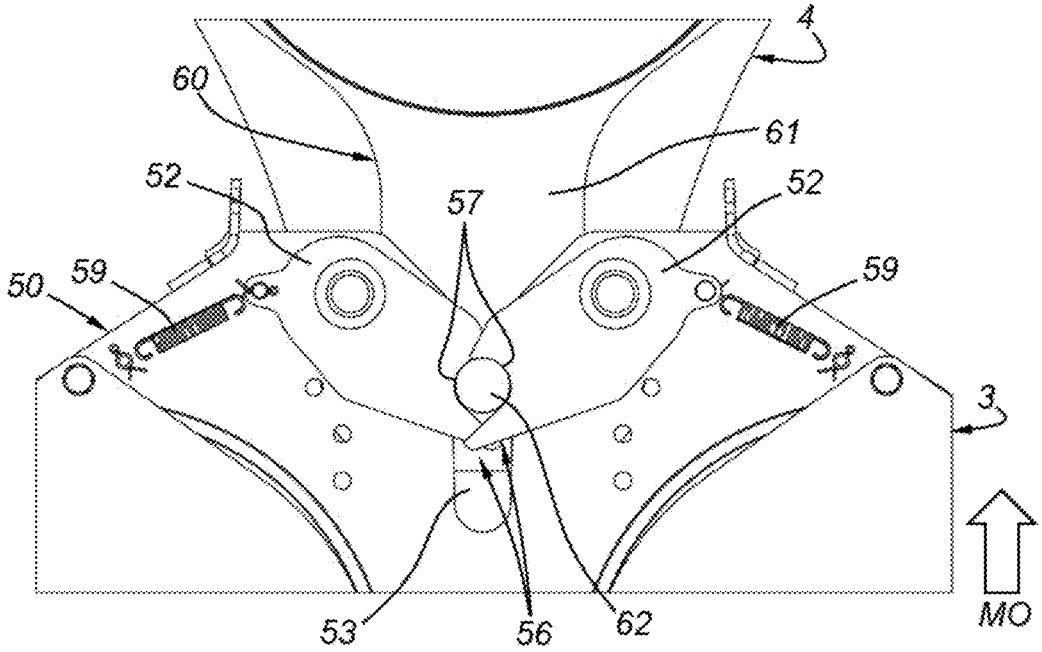
FIG. 4 is a schematic partial and front view of the upper reeve block and of the lower reeve block in the connected configuration, with the bolt engaged with two latches.

Referring to FIG. 4, in the connected configuration, the latches 52 are in the locking position and the bolt 62 is stuck inside the respective free ends 56 of the latches 52, more specifically with the bolt 62 stuck inside the indentations 57 of these free ends 56. In this connected configuration, the lower reeve block 3 can be descended together with the upper reeve block 4. Indeed, when the lower reeve block 3 descends with its latches 52, these latches 52 are blocked by the bolt 62 and cannot pivot towards the proximal position along the proximal rotational direction (upward pivoting). Thus, the latches 52 remain blocked in the locking position with the bolt 62 which, recall it, is secured to the upper reeve block 4. Hence, the upper reeve block 4 is connected to the lower reeve block 3 and therefore descends with the latter.

Figure 5:
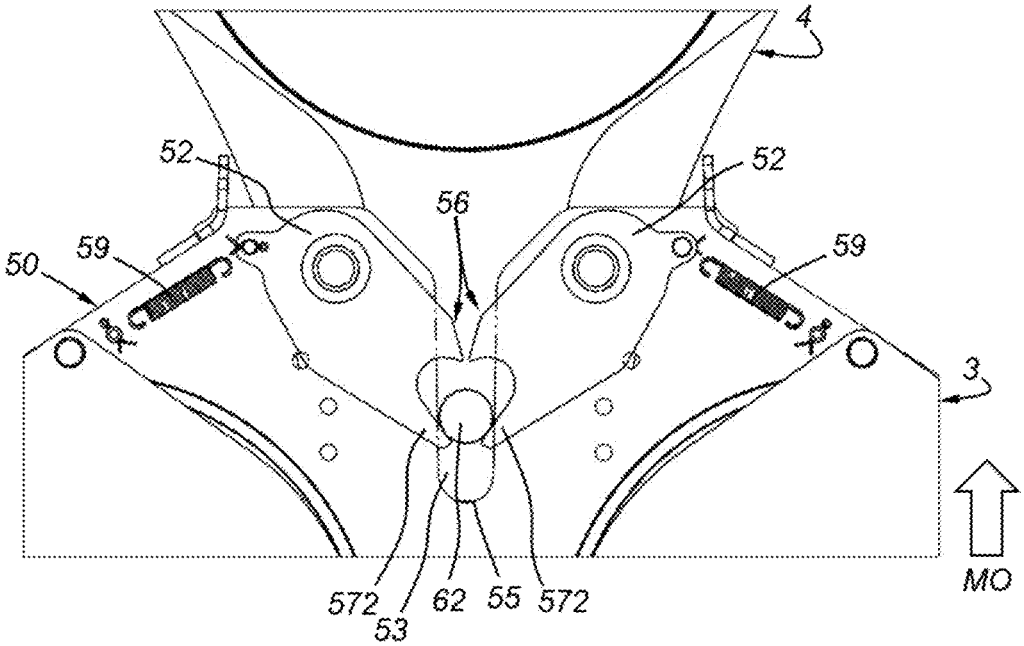
FIG. 5 is a schematic view equivalent to that of FIG. 4, at the beginning of a first step of a disconnection phase which follows the connected configuration of FIG. 4, during which the lower reeve block is raised until the upper reeve block reaches the high stop and the bolt starts sliding in the entry direction and starts being released from the latches which have reached an intermediate distal position.

Referring to FIGS. 4 and 5, to switch from the connected configuration into the disconnected configuration, the lower reeve block 3 is first raised (with the upper reeve block 4), as schematized by the arrow MO, until the upper reeve block 4 reaches the high stop on the jib, and more specifically until the upper stop 43 of the upper reeve block 4 abuts against the distribution trolley 9 (cf. FIG. 1 to the right). For this purpose, and as shown in FIG. 1, a slot 90 is provided, on the underside of the distribution trolley 9, in which the upper stop 43 fits and abuts.

Referring to FIG. 5, once the upper reeve block 4 is at the high stop, the lower reeve block 3 continues rising, as schematized by the arrow MO, while the upper reeve block 4 is blocked. Thus, as the locking channel 53 is rising, the bolt 62 slides inside this locking channel 53 in the entry direction (downwards), bearing in mind that the latches 52 would not resist this sliding and that the latches 2 will thus pivot in the distal rotational direction (downwards) by the effect of a push exerted by the bolt 62 on the distal sears 572 of the latches 52. Also, the latches 52 pivot downwards, whereas the bolt 62 slides in the direction of the bottom 55, until the bolt 62 leaves the inside of the free ends 56 of the latches 52 (and even leaves contact with the latches 52), and afterwards, as illustrated in FIG. 6, the latches 52 return back into the neutral position by the effect of their associated elastic biasing elements 59, and the bolt 62 is under the latches 62 (and is even disposed in the bottom 55 of the locking channel 53).

Figure 7:
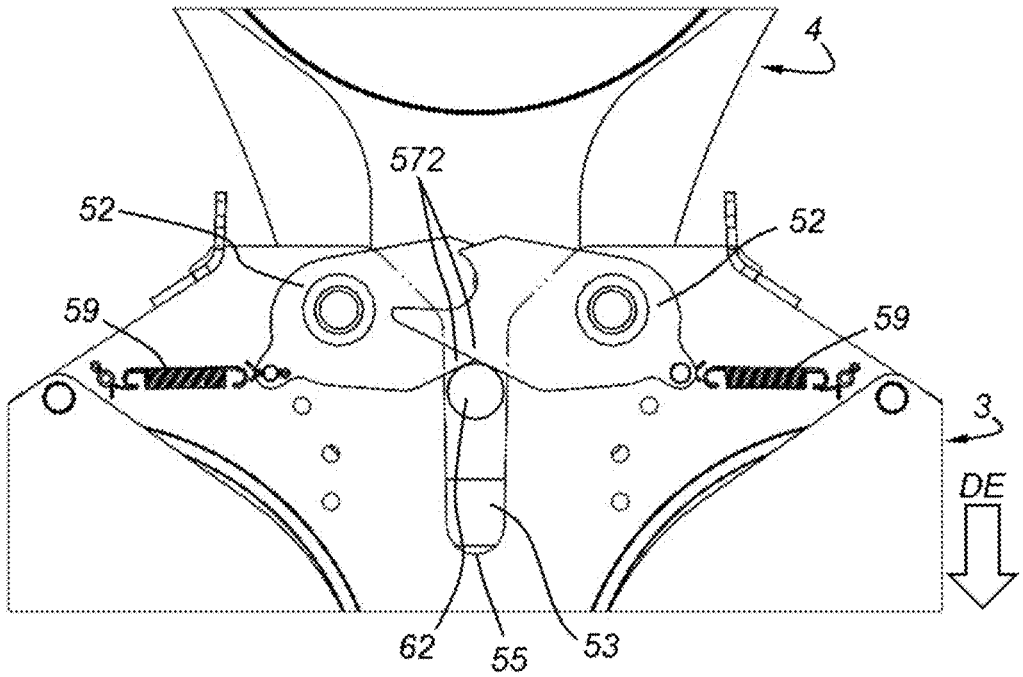
FIG. 7 is a schematic view equivalent to those of FIGS. 4-6, at the beginning of a second step of the disconnection phase, during which the lower reeve block starts descending so that the bolt starts sliding in the exit direction and comes into contact with the latches so as to push them towards their proximal position.
Figure 8:
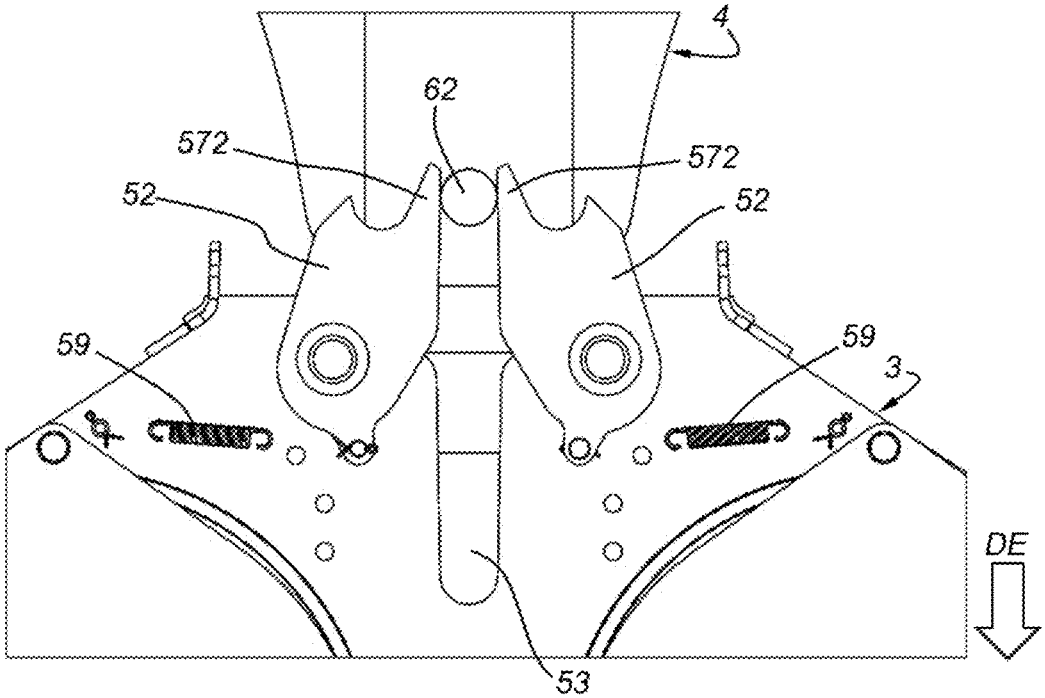
FIG. 8 is a schematic view equivalent to those of FIGS. 4-7, almost at the end of the second step of the disconnection phase, during which the lower reeve block continues descending so that the bolt has brought the latches into their proximal position and the bolt is ready to escape completely from the lower reeve block and from its latches.

Referring to FIG. 7, the lower reeve block 3 is displaced in descent, as schematized by the arrow DE, so that the bolt 62 slides inside the locking channel 53 in the exit direction (upwards), until bearing against the distal sears 572 of the latches 52, thereby pushing the latches 52 which then pivot in the proximal rotational direction (upwards) until reaching their proximal positions, as illustrated in FIG. 8, thereby enabling the bolt 62 to come out of the locking channel 53 and be released from the latches 52.

Thus, and as illustrated in FIG. 9, the bolt 62 is completely released from the locking mechanism 5 and the latches have returned back into the neutral position by the effect of their associated elastic biasing elements 59, and thus the lower reeve block 3 could continue descending alone in the disconnected configuration, without the upper reeve block 4 which remains at the level of the distribution trolley 9.

The following description covers a connection phase for the switch from the disconnected configuration into the connected configuration, with reference to FIGS. 10-13.

Referring to FIG. 10, in the disconnected configuration, the upper reeve block 4 hangs above the lower reeve block3 and the latches 52 are in the neutral position. To switch from the disconnected configuration into the connected configuration, the lower reeve block 3 begins by being raised, as schematized by the arrow MO, for a relative approach between the two reeve blocks 3, 4, until the bolt 62 comes into the locking channel 3, with reference to FIG. 11, through the mouthpiece 54 and comes into contact with the proximal sears 571 of the latches 52, thereby bringing the upper reeve block 4 reaches the high stop on the jib, and more specifically until the upper stop 43 of the upper reeve block 4 abuts against the distribution trolley 9.

Figure 11:
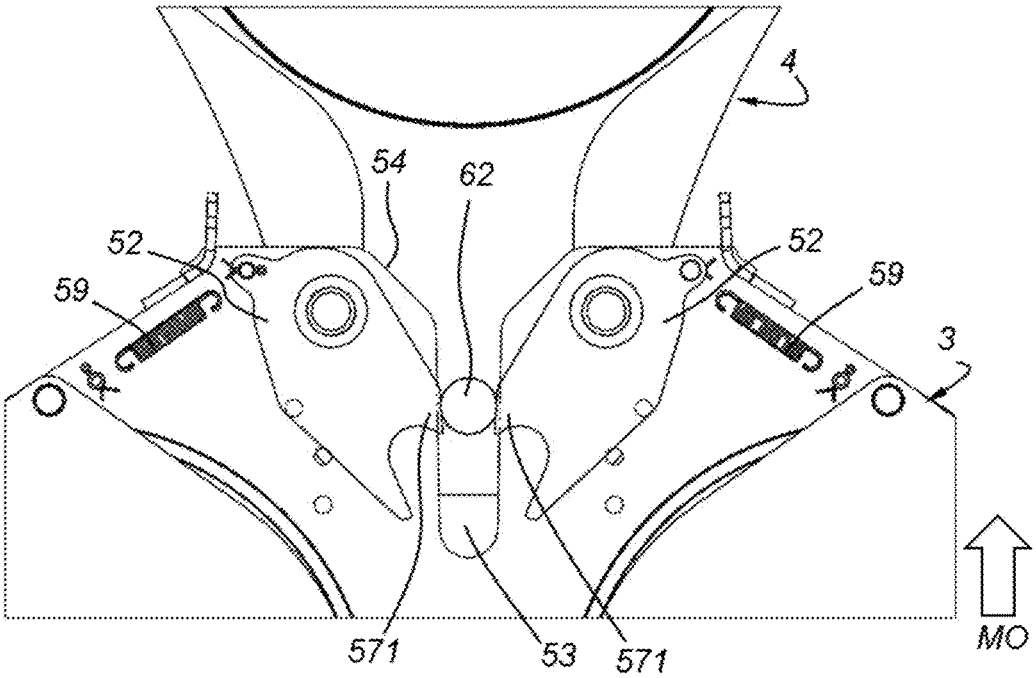
FIG. 11 is a schematic view equivalent to those of FIGS. 4-10, during the first step of the connection phase, wherein the lower reeve block continues rising until the bolt starts sliding in the entry direction and comes into contact with the latches so as to push them towards their distal position.
Figure 12:
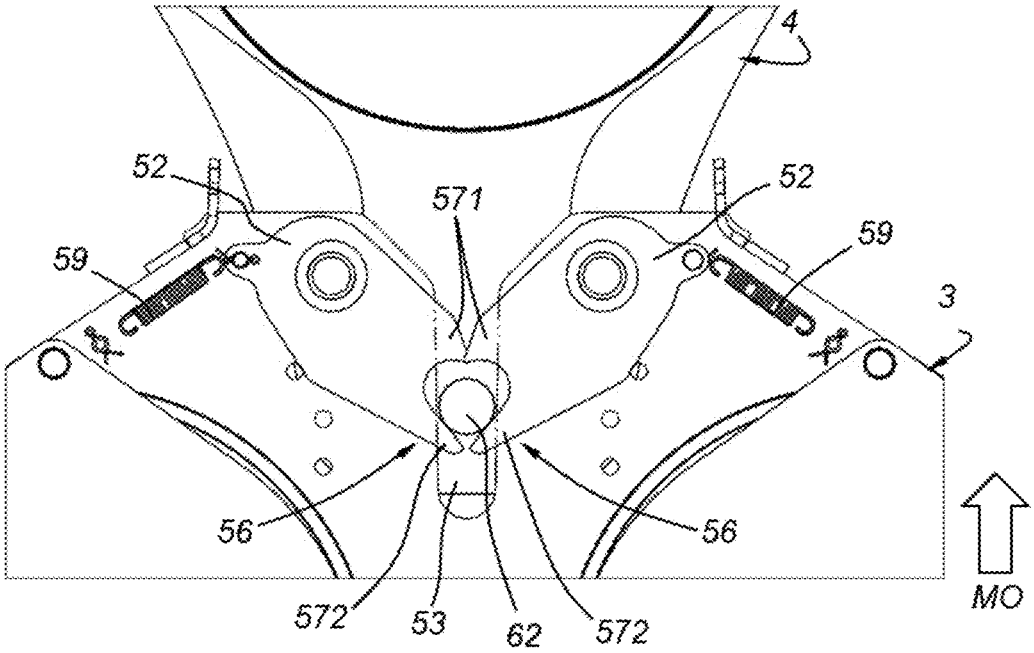
FIG. 12 is a schematic view equivalent to those of FIGS. 4-11, at the end of the first step of the connection phase, wherein the lower reeve block has finished rising so that the bolt has fitted into the free end of the latch.

Referring to FIG. 11, while carrying on the ascent of the lower reeve block 3, the bolt 62 exerts a push on the proximal sears 571 of the latches 52, while sliding inside the locking channel 53 in the entry direction (downwards), so as to bring the latches 52 into the distal position, until the bolt 62 leaves contact with the proximal sears 571 of the latches 52, and then the latches 52 pivot in the proximal rotational direction (upwards) until the distal sears 572 of the latches 52, in turn, come into contact with the bolt 62, as schematized in FIG. 12. Thus, and as shown in FIG. 12, the bolt 62 is engaged inside the free ends 56 of the latches 52.

Figure 13:
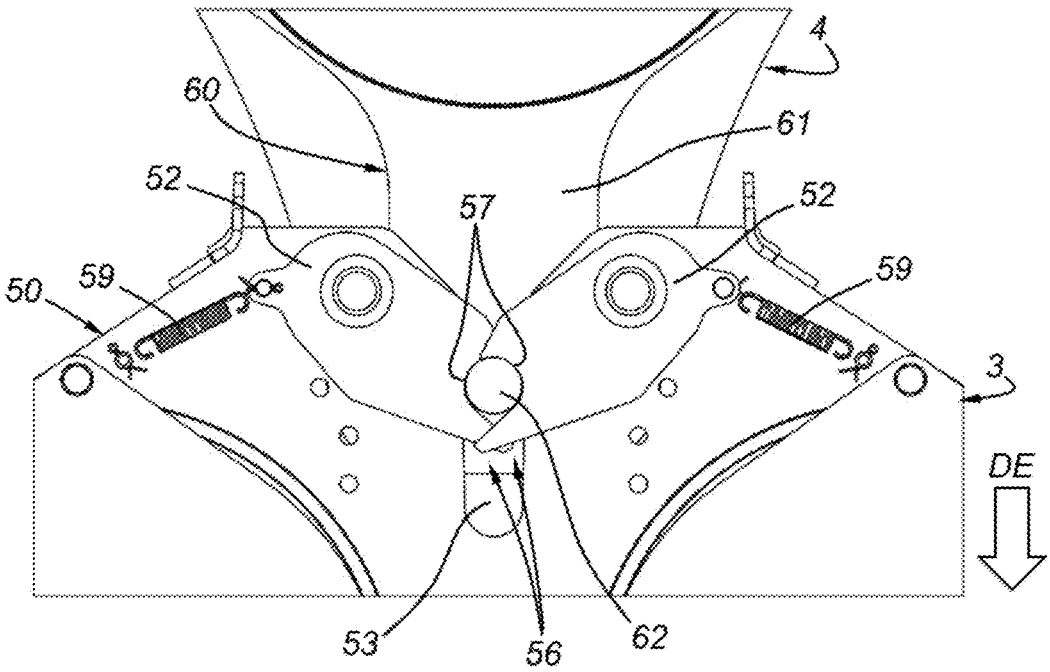
FIG. 13 is a schematic view equivalent to those of FIGS. 4-12, during a second step of the connection phase, during which the lower reeve block has descended so that the bolt has brought the latches into the locking position, and thus the bolt is stuck inside the free ends of the latches, so that the lower reeve block could descend with the upper reeve block in the connected configuration.

Referring to FIG. 13, the lower reeve block 3 is then displaced in descent, as schematized by the arrow DE, so that the bolt 62 slides inside the locking channel 53 in the exit direction (upwards), and brings the latches 52 into the locking position, until the bolt 62 is stuck inside the free ends 56 of the latches 52 and therefore its sliding in the locking channel 53 in the exit direction is blocked, and thus the lower reeve block 3 and the upper reeve block 4 are connected, and then the lower reeve block 3 could continue descending with the upper reeve block 4 in the connected configuration.

Thus, it should be noted that, in the connection phase and in the disconnection phase, only the control of the ascending/descending movements of the lower reeve block 3 allows switching from a connected configuration into the disconnected configuration, and vice versa. The control of the ascending/descending movements of the lower reeve block 3 is performed by controlling the lifting winch.

Also, it may be advantageous to automate the displacements of the lower reeve block 3, in the connection phase and in the disconnection phase, by means of a monitoring/control unit which drives the lifting winch. In this context of an automation of the connection and disconnection phases, it may be advantageous to provide for one or several sensor(s) allowing detecting relative positions between the lower reeve block 3 and the upper reeve block 4, such as for example a sensor allowing detecting when the upper reeve block4 is at the high stop on the jib, and more specifically when the upper stop 43 of the upper reeve block 4 abuts against the distribution trolley 9. Indeed, this position represents a starting point of the movements that will follow in the connection and disconnection phases.

Moreover, it could be considered to reverse the positions of the locking mechanism and of the complementary locking structure 6 of the reversible connection means, by arranging the locking mechanism 5 on the upper reeve block 4 and by arranging the complementary locking structure 6 on the lower reeve block 3. It is also possible to operate with one single latch 52 for the locking mechanism 5, by adapting the shape of the latch 52 to stick the bolt 62 in the locking channel 53. Alternatively, it is possible to operate with more than two latches 52 for the locking mechanism 5. It could also be considered to provide for elastic biasing elements 59 other than springs, such as for example elastic leaves, return mechanisms, or other equivalent means.

The invention claimed is:

1. A double-reeved lifting device for a lifting machinery, the lifting device comprising:

a lower reeve block secured to a lifting hook and an upper reeve block, wherein the reeve blocks comprise reversible connection means adapted to be reversibly configured between:

a connected configuration in which the upper reeve block is connected to the lower reeve block so as to be able to accompany the lower reeve block in ascending/descending movements along a main axis, and a disconnected configuration in which the upper reeve block is disconnected from the lower reeve block so as to be able to remain hanging above the lower reeve block such that the lower reeve block is configurated to perform descending/ascending movements without the upper reeve block, wherein the connected configuration and the disconnected configuration respectively correspond to a double-reeved configuration and to a simple-reeved configuration, or vice versa, of the double-reeved lifting device, wherein the reversible connection means comprise a locking mechanism mounted on one of the two reeve blocks, and a complementary locking structure mounted on the other one of the two reeve blocks and adapted to cooperate with the locking mechanism, wherein the complementary locking structure comprises a frame securely supporting a bolt formed at least partially by a shaft extending transversely to the main axis, and wherein the locking mechanism comprises:

a chassis comprising a locking channel having an elongated shape along the main axis and provided with a mouthpiece through which the bolt is configured to enter into and exit out of the locking channel and slide in the locking channel in an entry direction and in an exit direction, opposite to the entry direction, respectively upon a relative approach or distancing between the two reeve blocks, and at least one latch pivotally mounted on the chassis about a pivot axis so as to pivot inside the locking channel, wherein the latch is provided with a concave-shaped free end adapted to engage with the bolt, and is coupled to an elastic biasing element urging the latch towards a neutral position.

2. The double-reeved lifting device according to claim 1, wherein the latch is pivotally movable between:

the neutral position;

a distal position, in which the latch clears the passage for the bolt by the effect of a push exerted by the bolt sliding in the entry direction, wherein the distal position is associated to a pivoting of the latch in a distal rotational direction from the neutral position;

a proximal position, in which the latch clears the passage for the bolt by the effect of a push exerted by the bolt sliding in the exit direction, wherein the proximal position is associated to a pivoting of the latch in a proximal rotational direction, opposite to the distal rotational direction, from the neutral position; and a locking position, intermediate between the neutral position and the distal position, in which the free end of the latch blocks sliding of the bolt in the locking channel in the exit direction, with the bolt stuck inside said free end.

3. The double-reeved lifting device according to claim 1, wherein the free end of the latch has an indentation with a shape complementary to the bolt.

4. The double-reeved lifting device according to claim 3, wherein the bolt has a cylindrical section at a determined diameter, and the indentation of the free end of the latch has a circle-arc shaped load-bearing area.

5. The double-reeved lifting device according to claim 4, wherein the circle-arc shaped load-bearing area of the indentation of the latch has a diameter equivalent to the diameter of the bolt.

6. The double-reeved lifting device according to claim 4, wherein the locking channel has a width substantially equivalent to the diameter of the bolt.

7. The double-reeved lifting device according to claim 3, wherein the indentation of the free end of the latch is delimited by two opposite sears on which the bolt configured to exert a push, the two opposite sears including a proximal sear facing the mouthpiece of the locking channel in the neutral position, and a distal sear, wherein the proximal sear and the distal sear respectively have a proximal length and a distal length measured radially from the pivot axis, and the proximal length is smaller than the distal length.

8. The double-reeved lifting device according to claim 1, wherein the locking channel has a bottom, adapted to stop a sliding of the bolt in the entry direction, wherein the latch is disposed between the mouthpiece and the bottom of the locking channel.

9. The double-reeved lifting device according to claim 1, wherein the pivot axis of the latch is orthogonal to the main axis.

10. The double-reeved lifting device according to claim 1, wherein the at least one latch of the locking mechanism comprises two latches facing each other, pivotally mounted on the chassis on either side of the locking channel, the two latches being pivotable symmetrically with respect to a main plane including the main axis and parallel to the pivot axis of each of the two latches.

11. The double-reeved lifting device according to claim 10, wherein the two latches are identical and symmetrical with respect to the main plane.

12. The double-reeved lifting device according to claim 1, wherein the frame of the complementary locking structure comprises two flanges facing each other, between which the bolt is fastened.

13. The double-reeved lifting device according to claim 1, wherein the chassis of the locking mechanism comprises two plates between which the latch is pivotally mounted.

14. A lifting machinery comprising a jib and the double-reeved lifting device of claim 1 formed so as to lift/lower a load along the jib, wherein the lower reeve block hangs from the jib by a lifting rope connected to a lifting winch to make the lower reeve block ascend/descend, the lifting rope passing through the upper reeve block, and wherein:

starting from the disconnected configuration with the upper reeve block hanging above the lower reeve block and with the latch in the neutral position, the lower reeve block is configured to be raised for a relative approach between the two reeve blocks until the upper reeve block reaches a high stop on the jib and the bolt comes into the locking channel through the mouthpiece, slides inside the locking channel in the entry direction and exerts a push on the latch to bring the latch in a distal position until fitting inside the free end of the latch, and then the lower reeve block is configured to be displaced in descent so that the bolt slides inside the locking channel in the exit direction and brings the latch in a locking position, so that the bolt is stuck inside the free end and sliding of the bolt in the locking channel in the exit direction is blocked, so that the lower reeve block is configured to descend with the upper reeve block in the connected configuration; and starting from the connected configuration with the latch in the locking position and the bolt stuck inside the free end of the latch, the lower reeve block is configured to be raised until the upper reeve block reaches the high stop on the jib, and then the bolt slides inside the locking channel in the entry direction and brings the latch in an intermediate distal position, so that the bolt leaves the inside of the free end of the latch and afterwards the latch returns back into the neutral position by the effect of the elastic biasing element, and then the lower reeve block is configured to be displaced in descent so that the bolt slides inside the locking channel in the exit direction, pushes the latch towards a proximal position until coming out of the locking channel and being released from the latch, so that the lower reeve block is configured to continue descending in the disconnected configuration.

15. The lifting machinery according to claim 14, comprising a distribution trolley movably mounted on the jib and linked to a distribution system adapted to displace the distribution trolley along the jib in opposite forward direction and backward direction, and wherein the lower reeve block hangs from said distribution trolley by the lifting rope.

16. The lifting machinery according to claim 14, wherein the lifting machinery is a crane.

17. A method for lifting a load in a lifting machinery, the lifting machinery comprising a jib and the double-reeved lifting device of claim 1 formed so as to lift/lower a load along the jib, wherein the lower reeve block hangs from the jib by a lifting rope connected to a lifting winch to make the lower reeve block ascend/descend, the lifting rope passing through the upper reeve block, the method comprising:

connecting, in a connection phase for a switch from the disconnected configuration into the connected configuration, during which the lower reeve block is mounted for a relative approach between the two reeve blocks until the upper reeve block reaches a high stop on the jib and the bolt comes into the locking channel through the mouthpiece, slides inside the locking channel in the entry direction and exerts a push on the latch to bring the latch into a distal position until fitting inside the free end of the latch, and then the lower reeve block is displaced in descent so that the bolt slides inside the locking channel in the exit direction and brings the latch into a locking position, and thus the bolt is stuck inside the free end and sliding of the bolt in the locking channel in the exit direction is blocked, so that the lower reeve block is configured to descend with the upper reeve block in the connected configuration; and disconnecting, in a disconnection phase for a switch from the connected configuration into the disconnected configuration, during which the lower reeve block is raised until the upper reeve block reaches the high stop on the jib, and then the bolt slides inside the locking channel in the entry direction and brings the latch into an intermediate distal position, so that the bolt leaves the inside of the free end of the latch and afterwards the latch returns back into the neutral position by the effect of the elastic biasing element, and then the lower reeve block is displaced in descent so that the bolt slides inside the locking channel in the exit direction, pushes the latch towards a proximal position until coming out of the locking channel and being released from the latch, so that the lower reeve block is configured to continue descending in the disconnected configuration.

18. The lifting method according to claim 17, wherein the displacements of the lower reeve block, in the connection phase and in the disconnection phased, are automated.

* * * * *